US005115838A

United States Patent [19]

Derudder

[11] Patent Number: 5,115,838

[45] Date of Patent: May 26, 1992

[54] DRIVE SYSTEM FOR THE KNIFE GRIDS OF A DOUBLE-LIFT JACQUARD MACHINE

[75] Inventor: Carlos Derudder, Kortrijk, Belgium

[73] Assignee: N.V. Michel Van de Wiele, Kortrijk-Marke, Belgium

[21] Appl. No.: 550,898

[22] Filed: Jul. 11, 1990

[30] Foreign Application Priority Data

Jul. 17, 1989 [BE] Belgium ..... 8900775

[51] Int. Cl.[5] ..... D03C 3/32

[52] U.S. Cl. ..... 139/65; 139/1 E; 139/79; 74/53; 74/104

[58] Field of Search ..... 139/1 E, 65, 71, 59, 139/68, 79, 80, 81, 72, 62; 74/53, 104, 54, 569, 559, 112, 10.29; 112/466; 66/208

[56] References Cited

U.S. PATENT DOCUMENTS

| | | | |
|---|---|---|---|
| 2,656,729 | 10/1953 | Bellini | 74/54 |
| 3,143,985 | 8/1964 | Reeber et al. | 112/466 X |
| 3,889,720 | 1/1975 | Porter | 139/79 |
| 4,538,648 | 9/1985 | Corain | 139/79 |
| 4,614,212 | 9/1986 | Olenwine | 139/79 |
| 4,936,352 | 6/1990 | Keim | 139/65 |

FOREIGN PATENT DOCUMENTS

| | | | |
|---|---|---|---|
| 0297586 | 1/1989 | European Pat. Off. . | |
| 1535220 | 12/1970 | Fed. Rep. of Germany . | |
| 60-162833 | 8/1985 | Japan | 139/65 |

*Primary Examiner*—Andrew M. Falik
*Attorney, Agent, or Firm*—James C. Wray

[57] ABSTRACT

Drive system for the knife grids of a double-lift open-shed Jacquard machine, which is mounted entirely above the Jacquard machine, and which comprises a central drive shaft which at both ends drives a set of conjugate cams which imparts motion to two follower levers which lie diametrically opposite each other. These follower levers carry out a to and fro pivoting movement in opposite phase to each other, about a transverse axis of symmetry, in between their arms. With each pair of follower levers two knife suspension bars are connected to said arms by means of drive rods in such a way that they move up and down in vertical, parallel planes in opposite phase to each other. A number of knives are suspended in the weft direction on every two knife suspension bars moving in phase, which are situated on either side of the machine in the warp direction. The lift and the inclination of the knife suspension bars are adjustable.

9 Claims, 2 Drawing Sheets

DRIVE SYSTEM FOR THE KNIFE GRIDS OF A DOUBLE-LIFT JACQUARD MACHINE

BACKGROUND OF THE INVENTION

As regards the technique of driving the knife grids in double-lift open-shed Jacquard machines, a large variety of systems is known. However, all of them have a series of common disadvantages.

First, there is the place of mounting of the known drive systems. The latter are in fact always mounted at the bottom of the Jacquard machine, either along the front side, or along the rear side, which means that in any case ease accessibility of certain parts of the Jacquard machine becomes difficult.

An additional disadvantage of this mounting position of the known drive systems is that the drive of the knife grid has to take place by means of drive rods which push the knife grids upwards, as a result of the movement of the drive mechanism, while it is a known fact that a mechanism in which the drive rods are subjected to pressure load is less stable than a mechanism in which the drive rods are subjected to tension load.

Another disadvantage of the existing drive systems is that they all, of necessity, make use of additional auxiliary levers and drive rods, which makes these systems very complex.

SUMMARY OF THE INVENTION

The subject of the invention is a drive system for the knife grids of a double-lift open-shed Jacquard machine, and also such Jacquard machines equipped with such a drive system.

The object of the invention is to provide a double-lift open-shed Jacquard machine with such a drive system without the above-mentioned disadvantages occurring.

The drive system according to the invention is mounted mainly above the Jacquard machine and is characterized in that it comprises a central drive shaft which is disposed above the machine, by way of example in weft direction, and which is provided at both ends with a set of conjugate cams which in turn each drive, by means of cam-follower rollers, two fork-shaped follower levers which are placed diametrically opposite each other relative to the cam set.

The drive of these follower levers takes place by means of two cam-follower rollers per lever, each of which is driven by a different disk of the set of conjugate cams, while said cam-follower rollers are each placed in such a way on an arm of a follower lever that as a result of the rotation of the conjugate cam set each lever carries out an oscillating movement, pivoting to and fro about a fixed shaft, from which the two arms extend on either side. Disposed diametrically opposite a first follower lever is an identical second follower lever which is moved in opposite phase by the same cam set.

The end of one follower lever, which is, for example, in the down position, is connected to one side of a knife suspension bar, and the end of the other follower lever, which is also in the down position, is connected to the other side of the same knife suspension bar. A second knife suspension bar is connected in a similar manner to the ends of the follower levers which are in the up position.

The two knife suspension bars interacting with the cam set thus carry out an up and down movement in opposite phase to each other, in two vertical and parallel planes.

Such a drive is provided on both sides of the Jacquard machine, in such a way that each of the two knife suspension bars mating with one set of cams is always in phase with one of the knife suspension bars on the other side, which interacts with the other set of cams.

Each of this pair of knife suspension bars moving in phase, and lying along either side below the ends of the drive shaft, now acts as a pair of carriers of at least one horizontal knife disposed in the weft direction.

The slidable and pivoting method of connection of the drive rods, on the one hand to the arms of the follower lever and, on the other, to the ends of the knife suspension bars, in slots makes it possible to adjust both the lift and the inclination of the knife suspension bars.

Further characteristics and advantages of the drive system according to the invention will emerge from the description which follows of a preferred embodiment of the drive system, without the invention thereby being limited to said embodiment. This description is illustrated by the appended figures.

DETAILED DESCRIPTION OF THE DRAWINGS

Figure 1:
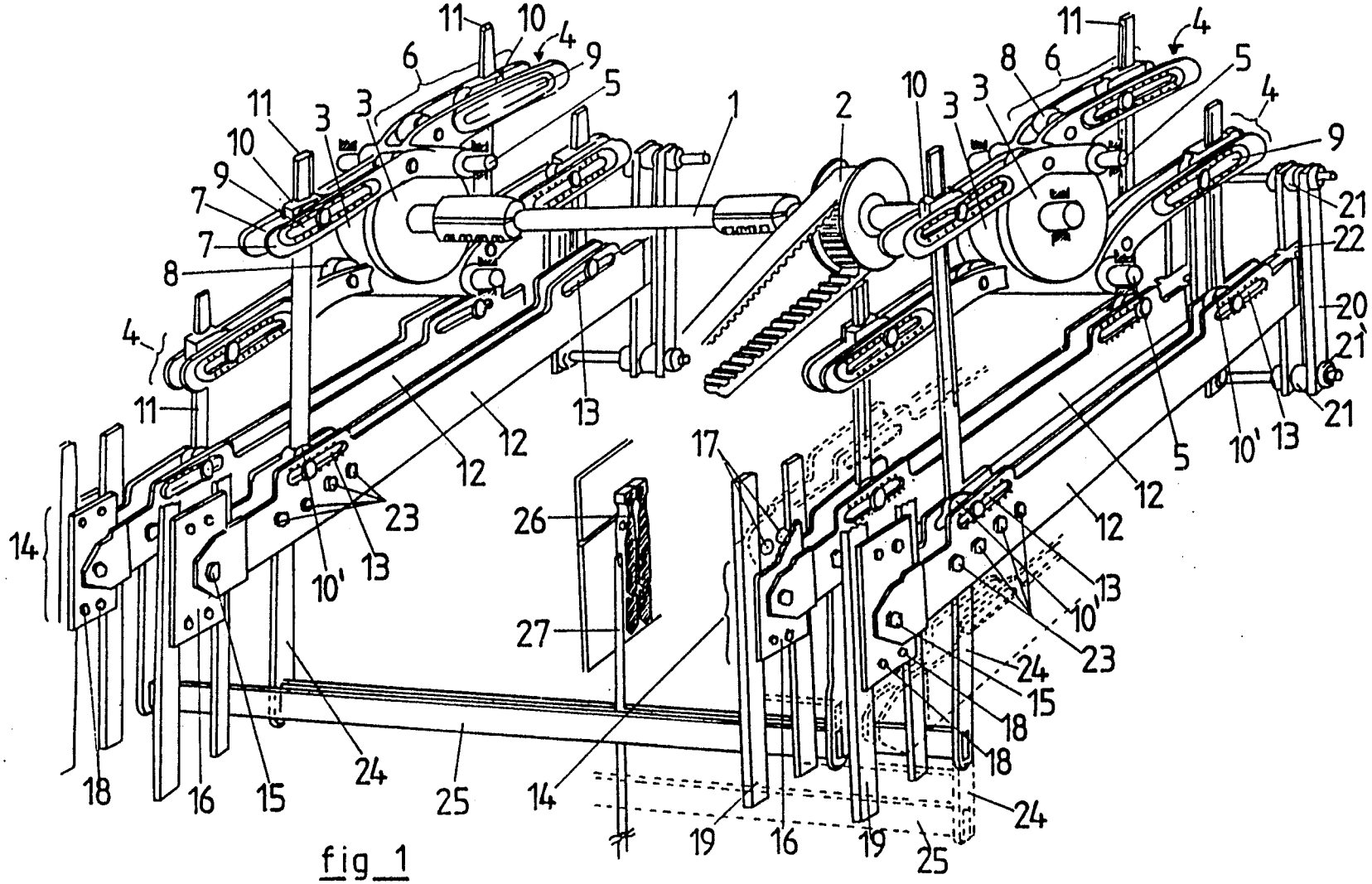
FIG. 1 shows a perspective drawing of the drive system according to the invention.

The drive system for a double-lift open-shed Jacquard machine according to the invention in its preferred embodiment (FIG. 1) is mounted above the Jacquard machine, parallel to the knives, and extends over their entire length. In what follows this direction will be called the weft direction.

The drive system is characterized in that it comprises a central drive shaft (1) which is mounted horizontally and parallel to the knives, with a length which following from the total structure must be in keeping with the length of the knives, and which is driven via a belt transmission (2) by the weaving machine.

On the ends close to the bearings of said central drive shaft (1), along each side, are a set of conjugate cams (3). Above and below each set of conjugate cams is a follower lever (4), rotatable about its shaft (5). Each follower lever (4) comprises two fork-shaped arms (6) which at each side end in the forks (7). Fixed between the forks in each case is a cam-follower roller (8), which always runs over its own cam (3). The cam-follower rollers (8), with their cams (3), run in parallel planes which are displaced relative to each other over a certain distance.

These follower levers (4) are mounted relative to the conjugate cams (3) and the distance between the two cams (3) of the same set corresponds to the lateral distance between one cam-follower roller (8) and the other cam-follower roller (8) of the same follower lever (4) in such a way that these cam-follower rollers (8) are driven by two different disks (3) of the conjugate cams.

Nearer to the end of these arms (6), a slot (9) is provided in the side of each fork (7) along its lengthwise direction. One cam-follower roller, connected to the bottom follower lever on, for example, the front arm relative to the oscillation point, runs on one cam disk, and the cam-follower roller connected to the top follower lever, also on the front arm relative to the oscillation point, runs on the other cam disk.

As a result of this design, each follower lever (4) carries out a to and fro pivoting movement about its axis (5), while two diametrically opposite follower levers (4) move in opposite phase relative to the same set of cams. A fixing piece (10) is in each case slidably fixed between the forks (7) in the slots (9), which are located in the forks (7) of each arm (6) of a follower lever (4), it being possible for the mounting position to vary over the entire length of the slots (9), and the fixing pieces (10) being able to pivot about a horizontal axis between the forks (7). These fixing pieces (10) are connected to a drive rod (11), the fixing height of which can be changed as the drive rod (11) is slid more or less through a slot in the fixing piece (10).

These drive rods (11) are provided to be connected, with the bottom end pivoting, to the respective knife suspension bars (12) which are situated in pairs in the warp direction, each below a set of cams (3) with interacting follower levers (4) and drive rods (11). This direction is always called the warp direction in what follows.

These knife suspension bars (12) are pivotly connected, by means of fixing pieces (10') located at their ends in each of the two slots (13), to two of the abovementioned drive rods (11), one end being connected by means of a drive rod (11) to an arm (6) of a follower lever (4), and the other end being connected by means of a drive rod (11) to an arm (6) of the other follower lever (4) which interacts with the same set of cams (3), and which extends along the other side of the cams (3).

By driving the follower levers (4) by a set of conjugate cams, the arms (6) of a follower lever (4) connected to the same knife suspension bar move up and down in phase, while the two knife suspension bars interacting with one cam set move up and down in opposite phase in two vertical parallel planes next to each other.

Two knife suspension bars (12) interact in the same way with the other set of conjugate cams (3) at the other end of the central drive shaft (1), it being ensured that each knife suspension bar (12) of one pair works in phase with a knife suspension bar (12) of the other pair.

The connection point of the drive rods (11) in the slots (13) of the knife suspension bars (12) by means of pivoting fixing pieces (10') can again be determined over the length of the slots (13).

Two guide systems are provided for each knife suspension bar (12) for the guidance of the knife suspension bars (12) during the up and down movements.

A first guide system, which comprises a roller carriage (14), is located along the front side and guides one end of the knife suspension bar (12) during its vertical movement. This roller carriage (14) is pivotly connected in fixing point (15) to the knife suspension bar (12) and comprises two vertical plates (16) of the same dimensions which extend parallel to each other and next to each other in the direction of the knife suspension bars, and between these plates (16) are 4 small rollers (17) which are disposed rotatably on a horizontal shaft (18), in connection with the two plates (16), and are positioned symmetrically in each corner of the two opposite plates (16).

This guide system also comprises two vertical guide strips (19) which are situated vertically, partially between the two plates (16), parallel to the vertical edges thereof, along the front and along the back, disposed in such a way that two rollers (17) are always against one guide strip (19), so that the rollers (17) during the up and down movements of the roller carriage (14) roll over the guide strips (19), as a result of which the roller carriage cannot leave its vertical path, in the warp direction by the rollers (17) pushing against the guide strips (19) and, on the other hand, in the weft direction by the plates (16) containing the guide strips (19), the result being that the roller carriage (14) cannot move sideways.

The second guide system for each knife suspension bar is situated along the rear side and guides the other end of the knife suspension bar (12). It is made up of two guides (20) which are fixed vertically next to each other on the structure, on horizontal bars (20'), the distance between these guides (20) being determined by two cylindrical intermediate pieces (21) which are slid onto the bars (20') and are situated between the guides (20), the guides (20) with intermediate pieces (21) being fixed in their place with a clamping connection on the bars (20').

The vertical gap produced in this way between the guides (20) now contains the end (22) of the knife suspension bar (12) which has to be guided by this system, this end (22) possibly having to be made narrower, in such a way that this narrower part can be located between the guides (20) and can move up and down there.

Each knife suspension bar (12) now contains a number of bolts and nuts (23) or other fixing means which cross the knife suspension bars, and these serve as a pivoting suspension of the carriers (24) bearing a knife (25) extending in the weft direction; each knife is in this case carried by two knife suspension bars (12) which interact with a different set of conjugate cams (3), and which move in phase with each other. In this way, we obtain, connected to the 4 knife suspension bars (12), a number of knives (25) which carry out up and down movements, and which move in opposite phase to another number of knives also moving up and down.

These knives (25) then in turn carry hooks (27) upwards, said hooks being selected by means of electromagnets (26) or otherwise.

The drive system for the knife grids of a double-lift open-shed Jacquard machine is also characterized in that the structure permits setting of the lift of the knife suspension bars (12) and also their inclination.

The regulation of the lift of the knife suspension bars takes place by setting the drive rods (11) by means of fixing pieces (10) and (10') in the respective slots (9) and (13) of the follower levers (4) and the knife suspension bars (12) respectively.

The greater the distance of the fixing place of the drive rod (11) on a follower lever (4) from the shaft (5) of said follower lever (4), the greater will be the amplitude of the vertical up and down movement carried out by said drive rod (11), interacting with the fork-shaped arm (6) fo said follower lever (4), which as a result of the conjugate cams (3) by which it is driven about its axis pivots to and fro.

By determining these fixing places, and by determining them equal for the two drive rods (11), which carry along the same knife suspension bar (12), we reach a setting of the lift of the knife suspension bars (12), and consequently of their knives (25), so that in this way the required lift of the shed can be set.

By determining the said fixing places, and by determining them unequal for the two drive rods (11), which carry along the same knife suspension bar (12), the two ends of a knife suspension bar (12) are not at the same height, so that the knife suspension bar is imparted a certain inclination, which can be necessary in order to give the warp ends a certain inclination required by the shed dimensions.

Since the knife suspension bars can have an inclination, the use of the pivoting fixing pieces (10) and (10') becomes clear, and also the use of the pivot point (15) and the rear guide system, while a (narrower) end (22) of the knife suspension bars (12) slides up and down between two guides (20). Through an inclination of the knife suspension bar this (narrower) end comes to rest at an angle between the guides (20), but guiding remains possible in this position, since a sufficiently long piece of the end (22) remains between the guides, while the roller carriage (14) is now connected to the knife suspension bar (12) at a different angle via the pivot point (15), and thus continues to carry out the guidance as before.

Figure 2:
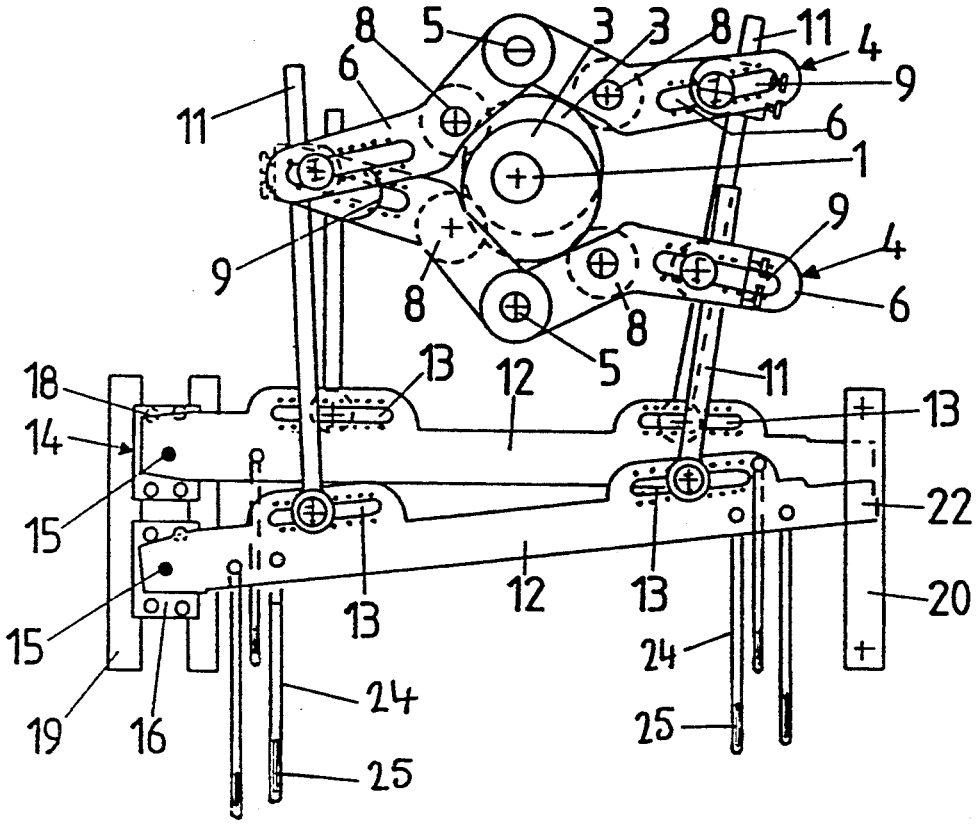
FIG. 2 shows a detail drawing in side view of a conjugate cam set with interacting follower levers, drive rods, knife suspension bars with guide systems, and knives.

In a schematic drawing (FIG. 2) one set of conjugate cams with their follower levers (4), drive rods (11), knife suspension bars (12) with guide systems (14) and (20) and knives (25) can be seen, one of the knife suspension bars (12) being imparted an inclined position.

An advantage of the invention lies in the fact that this entire drive linkage is located above the Jacquard machine, so that, on the one hand, the ease of accessibility of other parts in front of, at the rear of or under the Jacquard machine is not badly affected and, on the other, the drive takes place by means of drive rods (11) on which a tension load is exerted, which benefits the stability of the drive linkage.

An additional advantage of the drive according to the invention lies in the fact that the drive of the knives takes place in a relatively simple manner, without additional auxiliary levers, additional drive rods or additional pivots, and the fact that any horizontal movement is prevented in that way.

While the invention has been described with reference to specific embodiments, modifications and variations of the invention may be constructed without departing from the scope of the invention, which is described in the following claims.

I claim:

1. A drive system for the knife grids of a double-lift open-shed Jacquard machine, in which a mechanism is mounted above the Jacquard machine, characterized in that a drive shaft, rotating at uniform speed, is disposed at top of a Jacquard head and has at its both ends a set of conjugate cams, each of which drives positively two dual roller follower levers on a single piece dual lever arrangement, said arrangement having a central pivot point and extensions at both sides which contain slots to receive a suspension pivot.

2. The drive system as claimed in claim 1, wherein each of two fork-shaped arms of the same follower lever are driven via cam follower rollers by a separate cam disk, and wherein two follower levers interacting with the same set of cams carry out a to and fro pivoting movement in opposite phase about their pivot shaft, which connects their two arms and lies in a direction at right angles to said arms.

3. The drive system as claimed in claim 2, wherein knife suspension bars are connected, by means of drive rods, to the arms of said follower levers, while each knife suspension bar extends in a warp direction and is connected by one end to an arm of one of the two follower lever, while the other end is connected to the arm, lying along the other side relative to the central pivot point, of another follower lever which interacts with the same set of conjugate cams, and which moves in phase with the first-mentioned arm, so that there are two knife suspension bars interacting with each set of conjugate cams, lying below them, said suspension bars moving up and down in opposite phase in vertical parallel planes next to one another.

4. The drive system as claimed in claim 3, wherein during its up and down movement each knife suspension bar is guided by one end by means of a roller carriage comprising two plates lying parallel and next to each other and in line with the knife suspension bars, and between which there are four small rollers situated in pairs against a vertical guide board on which they can roll, in such a way that the roller carriage cannot move in the direction of the knife suspension bars.

5. The drive system as claimed in claim 3, wherein during its up and down movement each knife suspension bar is guided by one end between two guides which are situated parallel to each other and to the direction of movement, along either side of said end.

6. The drive system as claimed in claim 3, wherein the connection between the arms of the follower levers and the drive rods takes place by means of pivoting fixing pieces which are fixed in slots between the forks of the follower levers, the slots being located in the sides of said forks in their lengthwise direction and permitting the fixing pieces to be fixed at a selected place in said slots, and the above-mentioned drive rods being slidably fixed to the fixing pieces for height adjustment.

7. The drive system as claimed in claim 3, wherein the connection between the drive rods and the knife suspension bars takes place by means of pivoting fixing pieces which are fixed to the drive rods and which are fixed in slots, which slots are situated in the knife suspension bars, in their lengthwise direction, and allow the fixing pieces to be fixed at a selected place in said slots.

8. The drive system as claimed in claim 3, wherein fixing means are provided in the knife suspension bars and serve for the pivoting suspension of at least one carrier which is fixed in line with the drive rods, while each carrier bears the end of a knife which extends in the weft direction, and at its other end is supported by an identical carrier which interacts with the set of complementary cam disks at the other side of the drive shaft, and which moves up and down in phase with the first-mentioned carrier.

9. A double-lift open-shed Jacquard machine, provided with a drive system for the knife grids, said system being mounted above the Jacquard machine, characterized in that a drive shaft, rotating at uniform speed, is disposed at top of a Jacquard head and has at its both ends a set of conjugate cams, each of which drives positively two dual roller followers on a single piece dual lever arrangement, said arrangement having a central pivot point and extensions at both sides which contain slots to receive a suspension pivot.

* * * * *